United States Patent [19]

Dubinsky

[11] Patent Number: 4,567,907

[45] Date of Patent: Feb. 4, 1986

[54] UMBRELLA HAVING EASILY OPERATED PULLEY MEANS FOR OPENING AND CLOSING THE SAME

[76] Inventor: Emanuel Dubinsky, 3 Cross Ridge Rd., Chappaqua, N.Y. 10514

[21] Appl. No.: 624,753

[22] Filed: Jun. 26, 1984

[51] Int. Cl.[4] ..... A45B 11/00; A45B 25/06; A45B 25/08

[52] U.S. Cl. ..... 135/20 M; 135/28; 135/38

[58] Field of Search ..... 135/20 R, 20 M, 27, 135/28, 30, 37, 38, 39, 41, 903, 905, 42, 16

[56] References Cited

U.S. PATENT DOCUMENTS

| | | | |
|---|---|---|---|
| 196,723 | 10/1877 | Sundquist | 135/98 X |
| 475,736 | 5/1892 | Wyatt | 135/98 |
| 961,811 | 6/1910 | Shreckengast | 135/28 |
| 1,583,831 | 5/1926 | Hoigaard | 135/98 |
| 2,114,598 | 4/1938 | Grissel | 135/20 R |
| 2,568,362 | 9/1951 | Primavera | 135/20 M |
| 2,616,571 | 11/1952 | Griffin | 135/16 |
| 2,651,315 | 9/1953 | Witty | 135/20 R |
| 2,661,849 | 12/1953 | Spalding | 135/16 |
| 2,789,795 | 2/1957 | Small | 135/20 M |
| 2,937,653 | 5/1960 | Danciart et al. | 135/37 |

FOREIGN PATENT DOCUMENTS

| | | | |
|---|---|---|---|
| 360467 | 4/1962 | Switzerland | 135/98 |

*Primary Examiner*—Robert E. Bagwill
*Assistant Examiner*—D. Neal Muir
*Attorney, Agent, or Firm*—Philip Young

[57] ABSTRACT

A pulley system for opening and closing an umbrella which has a ribholder adapted for slidable movement along an umbrella pole. A pulley wheel is mounted in the umbrella pole below its top portion with one end of a pulley cord fixedly attached to the ribholder while the other end of the pulley cord extends below the closed umbrella cover with a first cord handle adapted for being grasped by an operator. The first cord handle has a locking pin adapted for insertion into a hole in the umbrella pole for stopping the downward travel of the ribholder and supporting the umbrella in its open position. A second cord handle is secured to the pulley cord at a predetermined distance from the first handle such that the second handle can be readily grasped and pulled further downward for raising the ribholder to permit the locking pin to be inserted into the hole for locking the umbrella in its open position.

5 Claims, 6 Drawing Figures

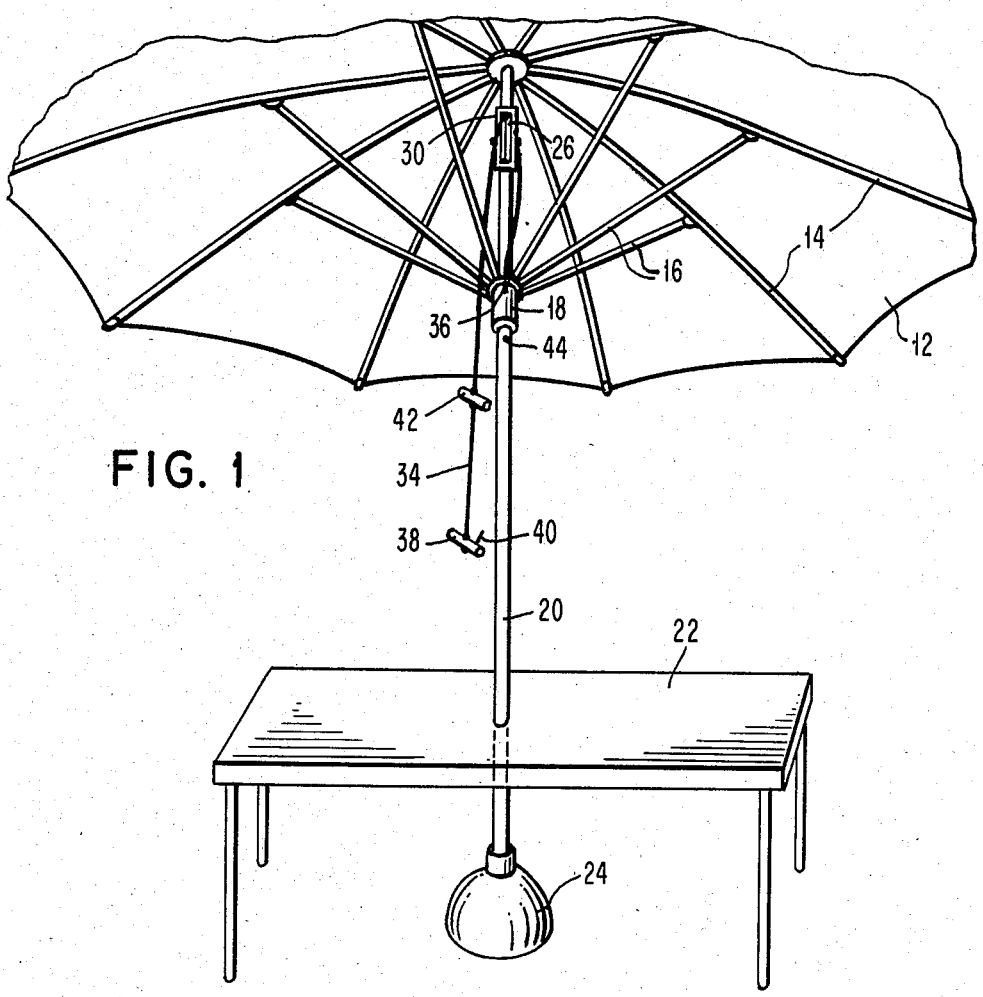
FIG. 1
FIG. 2.1
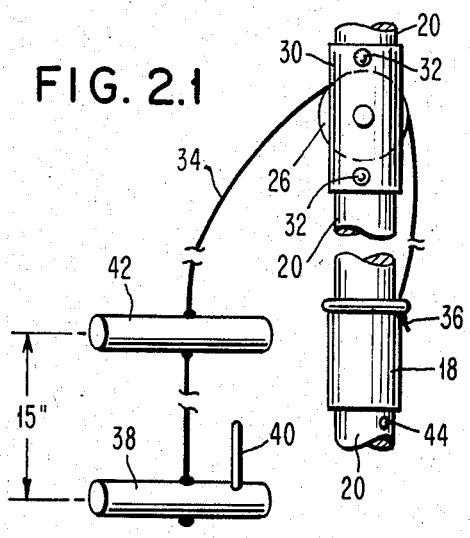
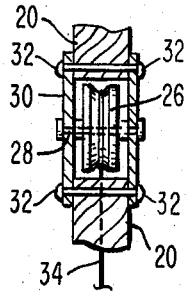
FIG. 2.2

FIG. 3.1
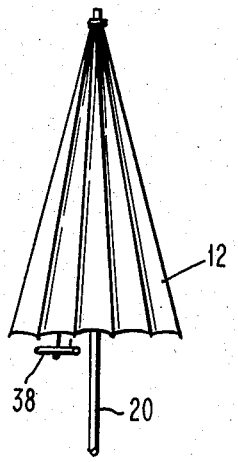
FIG. 3.2
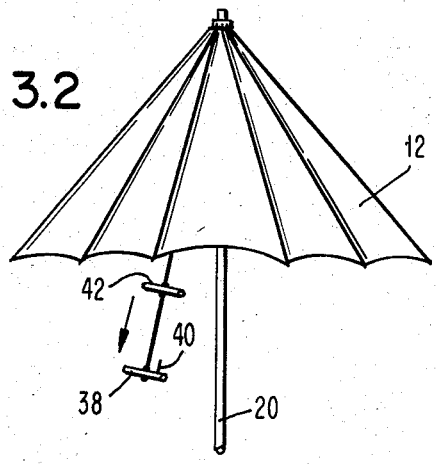
FIG. 3.3
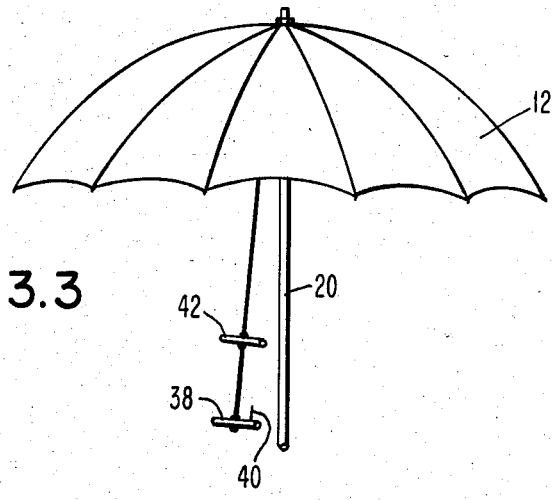

UMBRELLA HAVING EASILY OPERATED PULLEY MEANS FOR OPENING AND CLOSING THE SAME

TECHNICAL FIELD

The present invention relates to umbrellas and more particularly to the mechanism for opening and closing umbrellas.

BACKGROUND ART

Umbrellas that are made for awning type of use are generally large in size and, as a consequence, may be built with special systems for opening and closing such umbrellas. These systems presently used are generally of the pulley type or the spring type of system. In the pulley and cord system presently known for use with umbrellas a double pulley wheel arrangement is mounted at the top of the umbrella pole and attached at one end to the ribholder for lifting the ribs during opening, while the other end of the rope either freely extends on the outside of the umbrella pole with a pin used for supporting and locking the ribholder at a designated position on the pole where the pin extends through a small hole in the pole. Alternately, the pulley rope can be connected either internally through the inside of a hollow pole or externally near the bottom of the pole to a hand crank mechanism which controls the rope and, consequently, the opening and closing of the umbrella. In some of these type of pulley systems, a tongue type of spring is mounted near the top of the pole at a position where the spring extends outside of the pole for locking the rib holder at the designated height so that it does not slide below the spring position. Also, pressure springs are employed in the hand cranks for preventing the handle from going backwards and thereby locking the position of the umbrella in a ratchet-like manner.

In the pulley systems employing hand cranks, the crank mechanism and spring associated therewith are often subject to breakdown and involve relatively expensive manufacturing for the mechanism. Also, the pulley and cord system used in such umbrellas is complicated and, where hand cranks are not employed such pulley systems require that the operator raps the cord around his hand and then looks for the locking pin for insertion into the hole in the pole. This is cumbersome and a difficult manipulation for some users.

SUMMARY OF THE INVENTION

In view of the above, it is an object of the present invention to provide a pulley system for an umbrella which facilitates the opening and closing of such umbrella and is not cumbersome to operate. It is another object of the present invention to provide a pulley system for operating an umbrella which is not complex and requires a minimum number of parts. It is another object of the present invention to provide a means for operating a large umbrella which does not require the use of hand cranks, gears, springs or a double pulley system which are complex and expensive.

These and other objects are achieved by the present invention which provides a pulley system for opening and closing an umbrella, including a pulley wheel mounted in the umbrella pole below the top portion thereof, a pulley cord having one end attached to the umbrella ribholder that slides along the umbrella pole, such pulley rope extending operatively around the pulley wheel and having an overall length which is greater then the length of the umbrella so that the other end of the pulley cord is accessible when the umbrella is closed, a first handle secured near the free end of the cord and adapted for being grasped by the operator, said first handle including a long pin adapted for being inserted in the hole located in the umbrella pole for stopping the downward travel of the ribholder along the pole when the pin is inserted in such hole, a second handle secured to the cord at a predetermined distance from the first handle such that such second handle is accessible and visible when the first handle has been pulled down to open the umbrella to a first position whereby the second handle can be readily grasped by the same hand and pulled downward for raising the runner notch of the ribholder until it is above the hole in the pole, at which time the pin in the first handle is inserted into the hole for locking the umbrella into its open position.

The cord length is such that when the umbrella is closed, the first handle protrudes at the edge of the bottom of the umbrella cover so as to be visible and accessible. The umbrella can be opened with one hand by pulling on the first handle and easily opening the umbrella until the second handle is accessible. While holding the first handle, the second handle can be grasped with the other hand and pulled such that the umbrella is brought to its fully open position with the runner notch on the ribholder raised just slightly above the pole hole. While holding the second handle, the second handle with the pin is now completely loose and free of any stress, thereby allowing easy placement of the pin into the hole for locking the umbrella in a secure open position. The umbrella can be closed by simply pulling on the second handle to raise the umbrella runner notch a slight amount to remove the pressure from the pin whereby such pin is removed from the hole and the second handle can be raised to close the umbrella a first amount, after which the first handle is grasped and the umbrella lowered to its fully closed position.

In this fashion the umbrella pulley system of the present invention is both simple in structure and easy to operate and avoids the conventional complex external pulley systems and spring and crank umbrella systems presently known.

BRIEF DESCRIPTION OF THE DRAWINGS

FIG. 1 is a perspective view showing the pulley system incorporated in an umbrella, illustrative of the present invention;

FIG. 2.1 is a close-up view of the pulley system showing the handles and locking pin used in the system shown in FIG. 1; and FIG. 2.2 shows the pulley wheel;

FIGS. 3.1, 3.2 and 3.3 respectively show the umbrella and pulley system in the closed position, the intermediate position and the open position with the accessiblity of each of the cord handles illustrated in such positions.

DESCRIPTION OF THE PREFERRED EMBODIMENT

Referring to FIG. 1 there is shown a pulley system incorporated into a table umbrella 10 having a canopy 12 and a frame including ribs 14, support ribs 16, and a ribholder, also referred to as a runner notch 18. The runner notch supports the ribs 16 which are pivotly connected thereto, and such ribholder 18 is adapted to slide along the pole 20. As shown, the umbrella pole 20 extends through the top of a table 22 and is supported at its lower end by a base member 24. A pulley wheel 26 is incorporated in the pole 20 by means of its being mounted by a shaft 28 on an aluminum tube 30 which is mounted in a section at the top of pole 20 in rigid fashion such that the structural integraty of the pole is maintained. The upper and lower ends of the tube 30 can be press fitted onto the pole 20 and further joined by rivits 32 or other suitable fastening means.

A pulley cord 34 made, for example, of a high strength nylon, has one end 36 fixed or tied onto the ribholder 18, and such cord 34 extends around the pulley wheel 26 with its free end being attached to a handle 38. Handle 38 is securely attached to cord 34 and includes a locking pin 40, the use of which will be disclosed in detail below. A second handle 42 is fixedly secured to the cord 34 at a predetermined "Y" distance, for example 24 inches, from the free end of cord 34 having the handle 38 attached thereto. Handles 38 and 42 are made of wood although other materials such as plastic and metal can be suitably employed.

As shown in FIG. 1, a hole 44 is provided in the pole at a position which locks the umbrella in its fully open position by means of the locking pin 40 being inserted through hole 44.

FIG. 2 shows a detailed view of the pulley assembly including a more close up view of the handle 38 and locking pin 40, the second handle 42, the pulley wheel 26 and the tube 30 mounted with the pulley wheel 26 within the pole 20. FIG. 2 consists of FIGS. 2.1 and 2.2.

The length of cord 34 and the position of the first handle 38 and the location of the second handle 42 at a predetermined distance from handle 38 is more clearly illustrated in the FIGS. 3.1, 3.2 and 3.3. Here, in FIG. 3.1, the umbrella is shown in the closed position with the handle 38 protruding and visible at the edge of the bottom of the umbrella cover 12. In order to open the umbrella, handle 38 is pulled with one hand such that the umbrella easily opens, approximately 15 inches, to an intermediate position whereby the second handle 42 is accessible as shown in FIG. 3.2. While holding the first handle 38, the user then will grasp the second handle 42 with the other hand. In this fashion, the semi-open position of the umbrella shown in FIG. 3.2 now provides the needed leverage for easily pulling on the second handle 42 to raise the umbrella from such semi-open position into its completely open position, whereby the ribholder slide 18 is raised just above the hole 44 in the umbrella pole. At this point, the user is holding the handle 42 while the first handle 38 having locking pin 40 is completely loose and free of any stress, thereby allowing for easy placement of pin 40 into the hole 44. The umbrella is now in a well secured open position.

In order to close the umbrella, the second handle 42 is grasped and pulled to raise the umbrella runner slide 18 enough to relieve the pressure on pin 40 so such pin 40 can be pulled out of hole 44. At this point, the upper portion of the pulley cord 34 is taut since with the lower portion of cord 34 hanging lose, handle 38 and locking pin is pulled out of the hole with minimum effort and handle 38 is used to lower the umbrella from its semi-open position to its completely closed position in an easy and safe manner.

While the invention has been described above with respect to its preferred embodiments, it should be understood thet other forms and embodiments may be made without departing from the spirit and scope of the present invention.

What is claimed is:

1. A pulley system for opening and closing an umbrella which has an umbrella pole, a cover, frame support ribs and a ribholder adapted for slidable movement along said umbrella pole, comprising a pulley wheel mounted in said umbrella pole below its top portion, a pulley cord having one end fixedly attached to said umbrella ribholder, such pulley cord extending operatively around said pulley wheel and downward by a predetermined length to its free hanging end which extends below said umbrella cover and is easily accessible when said umbrella is closed, a lower first handle secured near said free end of said cord and adapted for being grasped by an operator, said first handle including a long pin adapted for being inserted in a hole located in said umbrella pole for stopping the downward travel of said ribholder for supporting said umbrella in its open position, an upper second handle secured to said cord at a predetermined higher distance from said first handle such that said second handle is accessible and visible when said first handle has been pulled down to open said umbrella to an intermediate position whereby said second handle can be readily grasped and pulled further downward for raising said ribholder above said hole in said pole, said second handle being used to maintain said rib holder above said hold while the pin on the first handle may be inserted into the hole for locking the umbrella into its open position.

2. A pulley system as recited in claim 1, wherein said pulley wheel is mounted in said umbrella pole by means of a cylindrical tube of rigid support material fixedly mounted in said umbrella pole with an opening for receiving said pulley wheel and said cord.

3. A pulley system as recited in claim 2, wherein said cylindrical tube is made of aluminum and said umbrella pole is made of wood.

4. A pulley system as recited in claim 1, wherein said first handle is secured to said cord at a distance of about 24 inches from said second handle to permit said first handle to reach said pole hole for insertion of said pin therein while said second handle is held.

5. A pulley system as recited in claim 1, wherein said pulley cord extends along the outside of said pole from said umbrella ribholder to said pulley wheel and down to where it terminates at said first handle at a height below the bottom edge of said cover in the closed umbrella position.

* * * * *